United States Patent [19]

Giancaterini et al.

[11] Patent Number: 4,590,092

[45] Date of Patent: May 20, 1986

[54] ALUMINIZATION PROCESS OF THE INTERNAL FACE OF THE SCREEN OF A COLOR TELEVISION TUBE

[75] Inventors: Gabriel Giancaterini, Rome; Francisco Pacifici, Frosinone, both of Italy

[73] Assignee: Videocolor, Montrouge, France

[21] Appl. No.: 654,614

[22] Filed: Sep. 26, 1984

[30] Foreign Application Priority Data

Sep. 27, 1983 [FR] France ..... 83 15338

[51] Int. Cl.[4] ..... B05D 5/06; B05D 5/12

[52] U.S. Cl. ..... 427/68; 427/73

[58] Field of Search ..... 427/68, 73

[56] References Cited

U.S. PATENT DOCUMENTS 2,910,376 10/1959 Stankey et al. ..... 427/72
3,821,009 6/1974 Lerner et al. ..... 117/33.5 CM
4,025,661 5/1977 Moscony et al. ..... 427/73 X
4,123,563 10/1978 Mitobe et al. ..... 427/68
4,339,475 7/1982 Hinosugi et al. ..... 427/64

OTHER PUBLICATIONS

Patents Abstracts of Japan, vol. 4, No. 28 (E-1) (510), Mar. 8, 1980, p. 36 E1.

*Primary Examiner*—James R. Hoffman
*Attorney, Agent, or Firm*—Pollock, Vande Sande & Priddy

[57] ABSTRACT

On the internal face of the frontal panel forming a color television tube, in order to obtain a cathodoluminescent screen, phosphors are deposited. A layer of aluminum must be deposited on the phosphors. An intermediate smoothening product, later decomposed, permits to obtain a layer of a satisfactory quality. A layer of ammonium tetraborate, forming microcrystals, is deposited on the product, piercing the aluminum layer so as to help the discharge of gases resulting from the decomposition of the intermediary layer.

2 Claims, 3 Drawing Figures

ALUMINIZATION PROCESS OF THE INTERNAL FACE OF THE SCREEN OF A COLOR TELEVISION TUBE

The invention concerns the aluminization procedure of the internal face of the screen of a color television tube.

A cathode ray tube for color viewing, specifically a television tube, consists of a frontal glass panel, the face of which is coated with phosphors, that is, luminescent substances which emit light when they are bombarded by electron beams produced by electron guns inside the tube. The phosphors are deposited on the glass in the form of strips or points and are covered by a layer of aluminum. This layer, connected to the ground, is adapted to discharge the incident electrons and to constitute a mirror reflecting to the front, the light emitted towards the back of the tube. The phosphors form an irregular layer. If aluminum was deposited directly on it, the reflection coefficient of said layer would be low, which would be against the purpose to be reached. Due to this, before a layer of aluminum is deposited on the phosphors, a layer of an organic matter in solution (or an emulsion in water) is deposited, which contrary to phosphors gives a smooth surface on which the aluminum may then be deposited. The organic matter is then eliminated by heat treatment at a temperature higher than 350° C. During this treatment, this matter is decomposed into various gases which escape through the aluminum which is relatively porous due its limited thickness. However, in general the aluminum is insufficiently porous. This is the reason why blisters or bubbles may form, altering the reflectivity. Also, parts of the metallic layer may even detach thus hindering the operation of the electron guns and/or block the mask-holes generally used for color selection.

To overcome this drawback (blister formation) it has already been proposed (U.S. Pat. No. 3,821,009) to spray a crystal forming solution on the organic matter, destined to pierce the aluminum layer in order to facilitate the escape of gases which result from the decomposition of the organic matter.

But until recently, the products used to make rough the surface of the organic matter on which the aluminum layer is to be deposited have not been fully satisfactory having shown, after the manufacture of a large number of tubes, that an important proportion still showed blisters on the aluminum layer.

The invention permits to the reduction of the probability of formation of the said blisters.

It is characterized in that the surface roughness of the organic matter covering the phosphors and the glass surrounding these phosphors is obtained by the projection of a solution specifically an aqueous solution, or of a suspension of ammonium tetraborate, preferably hydrated, ($NH_4HB_4O_7.x\ H_2O$).

It has be ascertained that with the process in accordance with the invention, the probability of blister formation on the aluminum layer is particularly low and that a very small quantity of the product needs to be projected on the organic matter, which thus reduces the manufacturing cost.

Moreover, after treatment, a boric anhydride residue $B_2O_3$ remains, which has the advantage of increasing the adherence between the aluminum and the phosphors and between the aluminum and the glass. In fact, the boric anhydride remains stable at maximum temperatures, generally in the range of 450° to 480° C., at which the tube is submitted during its manufacture and, at this temperature the material forms a highly viscous paste which spreads uniformly between the aluminum and the glass and between the luminescent material and the aluminum. However, this property of adherence improvement is not confined to ammonium tetraborate. When using boric acid, according to a known manner, a residue of boric anhydride $B_2O_3$ may also be obtained after treatment.

According to experiments made by the inventors, the probability of diminishing the blister formation of the aluminum layer and the reduction in the quantity of material projected on the organic matter result in the following properties of the ammonium tetraborate.

After projection and drying, the microcrystals which pierce the aluminum layer are smaller and better disposed than with the materials used previously. The result is a large number of holes in the aluminum layer, thus a better gas discharge and thus a smaller risk of blister formation. When the temperature increases, the hydrated ammonium tetraborate decomposes, especially by the progressive and continuous evaporation of the water, thus minimizing the risk of blister formation: on the contrary, with boric acid or ammonium axalate, or even the compound $Na_2B_4.10H_2O$, the decomposition is much faster, the probability of blister formation being directly proportional to the speed of decomposition or evaporation.

It is further to be noted that the quantity of product used being very small, the residue is minimal after heat treatment. This minimization of vitrified residue assures a better bombardment of the phosphors (the residue forming a thinner screen to the electron beam) and a greater reflection of light by the aluminum layer.

Other characteristics and advantages of the invention will be exposed with the description of certain embodiment methods, explained with reference to the drawings annexed herewith in which.

Figure 1:
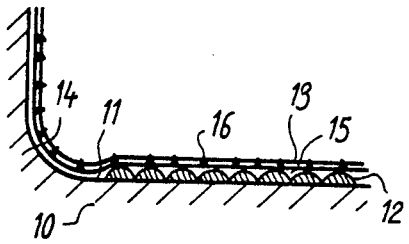
FIG. 1 is a partial section of a color television tube during manufacture.

A color television tube comprises a thick glass enclosure with a frontal panel 10, the internal surface of which is coated with phosphors 12, in points or in strips, which are selectively bombarded by three electron beams (not represented) issuing from three electron guns inside the glass tube. The color of each excited triplet of points depends on the relative intensity of the electron beams. In order that an electron beam hits only one phosphor of the color required, a perforated mask (not represented) is usually placed near the phosphors inside the vacuum tube.

The phosphors 12 are deposited directly on the internal surface 11 of the panel 10 and are covered with an aluminum layer 13 having two purposes: on the one hand discharging to the ground the electrons striking the screen, and on the other hand, reflecting outwards, that is towards the exterior of the tube, the light emitted by the phosphors 12 inwards, that is towards the interior of the tube. The aluminum is also deposited around the tube so that the peripheral zone 14, which is very often outside the television box, is opaque. In this manner the tube has no transparent zone, which would not be aesthetic for the viewer.

Prior to the deposit of the aluminum layer, a layer 15 of organic material is deposited on the phosphors 12, comprising for example, an emulsion of acrylic resins, polyvinylic alcohol and water. This layer 15, deposited on the face of the luminescent points receiving the electrons, has a smooth surface which permits to obtain an approximately smooth aluminum deposit 13.

A solution of a crystaline material is sprayed on the smooth surface of the layer 15 which, after drying, forms microcrystals 16 with heights greater than the thickness of the aluminum layer 13 which is deposited. These microcrystals form holes in the said aluminum layer.

Figure 2:
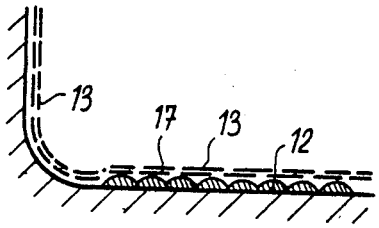
FIG. 2 is the same section as that of FIG. 1 after heat treatment.

After the deposit of the aluminum layer 13, the tube is submitted to a heat treatment so that the internal deposits reach temperatures higher than 350° C. at which the microcrystals 16 and the organic layer 15 decompose. The gases resulting from this decomposition escape through the holes formed by the microcrystals 16. In this manner the probability of blister formation in the aluminum layer 13 (FIG. 2) is reduced.

In accordance with the invention the aqueous solution which is sprayed on the surface of the organic layer 15 is a solution of ammonium tetraborate, preferably hydrated ammonium tetraborate [$NH_4HB_4O_7.x\ H_2O$].

This sprayed solution is then dried by blowing hot air or by another type of heating. After drying, the microcrystals 16 remain. Thereafter, as already described the aluminum layer 13 is deposited.

During the heat treatment the microcrystals of hydrated ammonium tetraborate undergo an important reduction in volume because water $H_2O$ and ammonia $NH_3$ escape in the form of gases. Therefore, only a residue due 17 of boric anhydride $B_2O_3$ with a small volume remains. This minimal residual volume permits to reduce to a minimum the surface of the remaining holes, which remain closed, this opening an easier passage to the gases resulting from the decomposition of the organic layer 15.

In this manner, blister formation, on the screen as well as around it, is less probable with a hydrated ammonium salt than with other products.

In comparative experiments between a boric acid solution and an ammonium tetraborate solution the following results were recorded:

for a frontal panel;

with 3% solutions in both cases,

| | boric acid | tetraborate |
|---|---|---|
| deposited volume | 5 $cm^3$ | 2,5 $cm^3$ |
| weight of residue | 84 mg | 50 mg |

It may be noted that the invention reduces considerably the weight of the solid residues.

During the comparative experiments it was determined that the blisters under the aluminum layer were mainly provoked by a sudden loss of water in the boric acid solution. Between 100° C. and 150° C., this sudden loss provokes a flux of water vapor responsible for the formation of the blisters. A solution in accordance with the invention and with a similar concentration undergoes a much more progressive dehydration.

Figure 3:
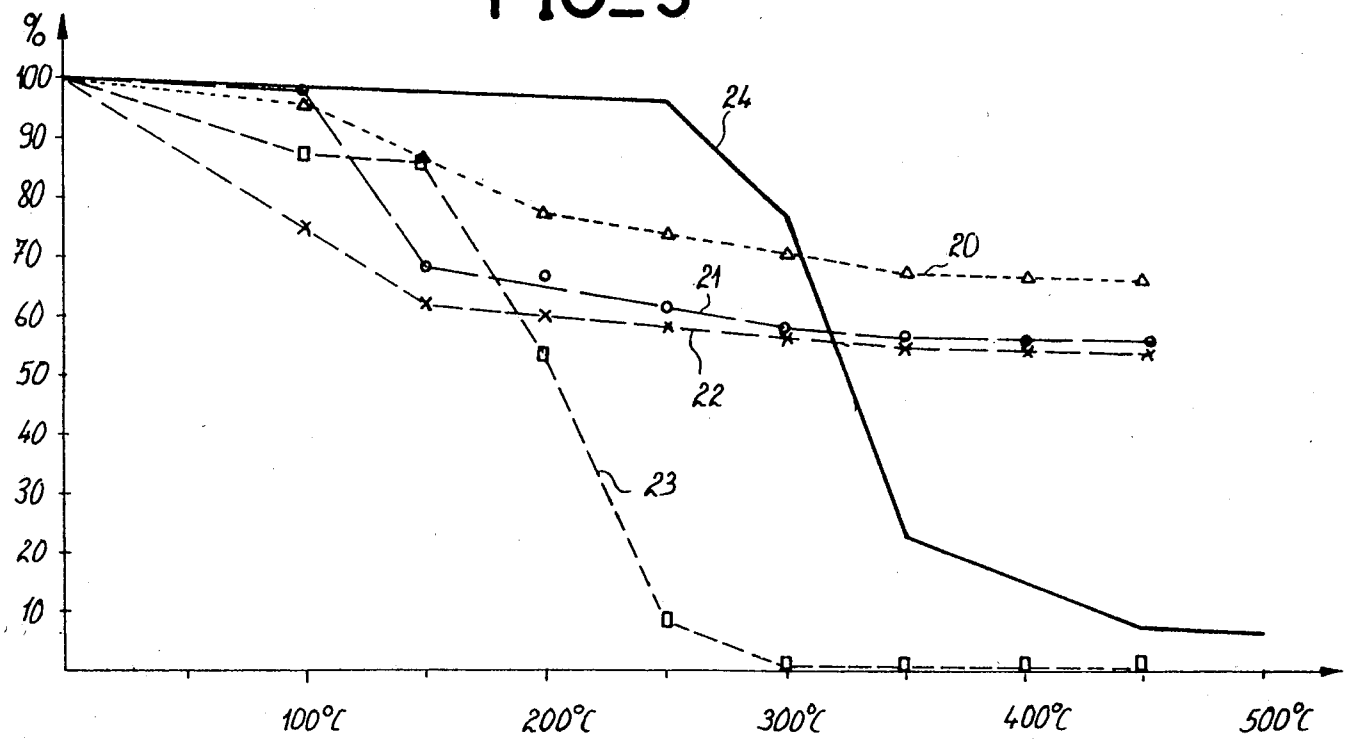
FIG. 3 is a comparative diagram.

The FIG. 3 is a diagram illustrating these comparative experiments and other experiments. The abscissa represents the temperature of the heat treatment in degrees Celsius, whereas the ordinate represents the loss in weight of the different layers. The curve 20 concerns the hydrated ammonium tetraborate, the curve 21 represents the loss in weight of the boric acid with the same concentration conditions. The curve 22 shows the loss in weight of borax with the chemical formula [$Na_2B_4O_7,10H_2O$]. The curve 23 concerns the use of ammonium oxalate and the curve 24 shows the loss of weight in function of the temperature of the layer 15.

Research undertaken by inventors has shown that ammonium oxalate is an organic compound which evaporates completely and gives no residue permitting the improvement of the adherence between the phosphors and the aluminum layer and between the glass and the said aluminum layer. Furthermore, as shown in the curve 23 the ammonium oxalate evaporates quickly; thus decreasing the risks of blister formation.

Boric acid leaves, after decomposition, a residue $B_2O_3$ which improves the said adherence. Ammonium tetraborate leaves the same residue. In any case, the advantage of this latter substance with respect to boric acid is, as shown in curves 20 and 21, that the decomposition speed of ammonium tetraborate is less than the decomposition speed of boric acid; therefore with ammonium tetraborate there is less risk of blister formation.

Finally, borax [$Na_2B_4O_7.10H_2O$] decomposes also much faster than ammonium tetraborate (see curve 22). The risk of blister formation is therefore greater. Also, the residue left by borax does not have the adherence properties of the residue $B_2O_3$.

We claim:

1. Method of aluminizing the interior face of the screen of a cathode ray tube, comprising:

depositing a layer of luminescent elements on the interior face on the screen;

depositing an organic layer on the luminescent elements and on the interior face of the curved portion of the tube;

spraying a solution which includes ammonium tetraborate or hydrated ammonium tetraborate on the organic layer;

drying the sprayed solution to form therefrom microcrystals for roughing the surface of the organic layer;

depositing a layer of aluminum on the roughed surface, apexes of the microcrystals piercing through the layer; and heating the tube to decompose the organic layer, whereby gas resulting from the decomposed organic layer escapes through holes in the aluminum layer formed by the apexes of the microcrystals.

2. Method according to claim 1, wherein the drying step includes the blowing of hot air.

* * * * *